United States Patent [19]

Cadwalader

[11] 4,065,140

[45] Dec. 27, 1977

[54] SKI SEAT

[76] Inventor: Louise G. Cadwalader, P.O. Box 135, Homewood, Calif. 95718

[21] Appl. No.: 652,668

[22] Filed: Jan. 27, 1976

[51] Int. Cl.[2] ..... A63C 11/00; A47C 9/10

[52] U.S. Cl. ..... 280/11.37 E; 135/66; 297/129

[58] Field of Search ..... 280/11.37 E, 11.37 J, 280/12 F; 297/129, 4, 6, 118, 283; 135/65, 66, 67

[56] References Cited

U.S. PATENT DOCUMENTS

| | | | |
|---|---|---|---|
| 384,790 | 6/1888 | Schiff | 135/66 X |
| 1,137,405 | 4/1915 | Jennings | 139/387 R |
| 2,257,831 | 10/1941 | Wood | 280/11.37 E |
| 3,095,017 | 6/1963 | Bleiler et al. | 139/387 R |
| 3,266,529 | 8/1966 | Bunger | 139/387 R X |
| 3,472,288 | 10/1969 | Kohlhagen | 139/387 R |
| 3,874,687 | 4/1975 | Cadwalader | 280/11.37 E |
| 3,902,731 | 9/1975 | Fagen et al. | 280/11.37 E |

*Primary Examiner*—Joseph F. Peters, Jr.
*Assistant Examiner*—Milton L. Smith
*Attorney, Agent, or Firm*—George H. Mitchell, Jr.

[57] ABSTRACT

A collapsible seat for skiers comprises a narrow, elongated web provided with a centrally facing pocket at each end so that the handle portions of a pair of ski poles can be inserted into the respective pockets to suspend the central portion of the web for supporting a person in a seated position. At one or both ends of the web, a second centrally facing pocket can also be provided spaced from the endmost pocket to provide an adjustment of the height at which the seat will be suspended from the poles. A belt, or tape, can be inserted lengthwise through the center of the elongated web in an elongated direction to convert the article into a pouch which can be suspended from the waist by means of the belt or tape.

8 Claims, 8 Drawing Figures

FIG 1
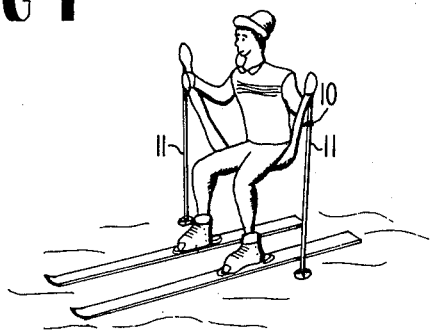
FIG 2
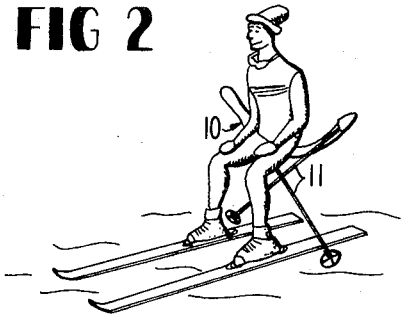
FIG 3
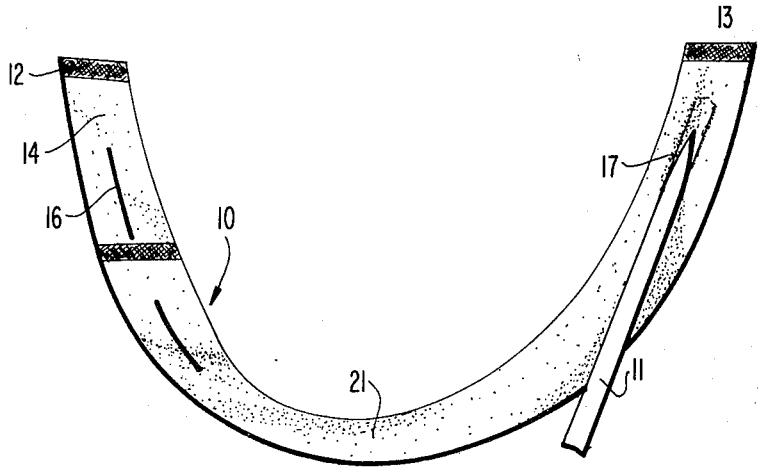
FIG 4
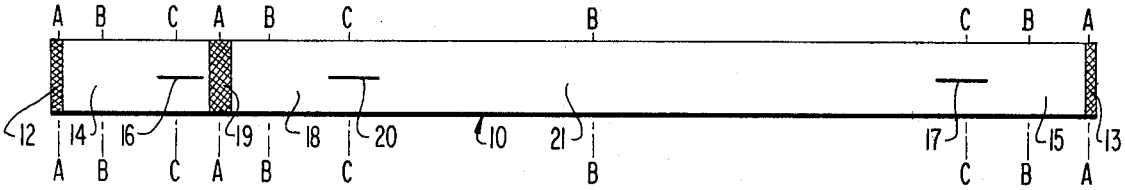
FIG 8
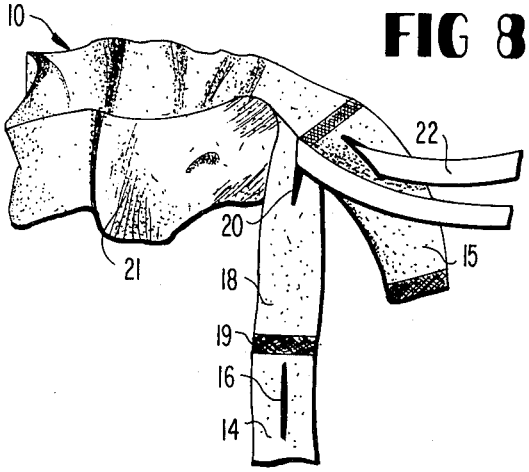
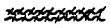
FIG 5
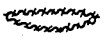
FIG 6
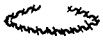
FIG 7

SKI SEAT

This invention is an improvement over the ski seat disclosed and claimed in my prior U.S. Pat. No. 3,874,687, granted Apr. 1, 1975. Other ski seats which are used by suspending them from a pair of ski poles are disclosed in the U.S. Pat. Nos. 2,257,831 and 3,902,731.

In my prior U.S. Pat. 3,874,687, the collapsible seat is composed of a narrow fabric web having a pair of flat metal plates either sewed or rivetted to the respective ends of the web, each of the metal plates including a metal hook to be connected with a knotted length of rope with one end of each of the ropes being in turn attached to a fabric cap which is placed in an inverted position over the top of each ski pole. It will be appreciated that such an arrangement requires considerable manual labor for fabrication in view of the fact that at least three pieces of fabric, two lengths of rope and at least four pieces of metal are involved during the process of fabrication.

Therefore, an object of the present invention is to simplify the construction of a collapsible ski seat by eliminating all metal parts such as clips, snaps, grommets or strengthening plates and by fabricating the article with a minimum amount of labor involved.

I have now discovered that ski seats of this type can be fabricated from a single elongated, tubular fabric web, thus doing away with the necessity of assembling a series of separate parts.

Furthermore, while my prior article depended upon the use of a series of knots provided in the suspending ropes in order to adjust the height of the seat, the present invention avoids all of these extraneous items by providing a pocket at each end of the elongated web into which the handles of the ski poles are inserted and also includes at least one other pocket spaced from one of the ends of the web which serves to adjust the height of the seat by providing an alternative pocket for the handle of one of the poles.

In a preferred form of the invention, the web may be fabricated on a conventional narrow fabric loom in which a set of warp threads extend throughout the length of the web and by manipulating the loom harness, the insertion of the weft threads can be controlled in such a way as to weave the elongated web so as to integrally form the pockets at the ends of the web and at least one additional pocket in a continuous operation.

However, it is also within the scope of the invention to form the article from a pair of superposed fabric articles in which certain areas of the two layers of fabric are joined together in a transverse direction to form the pockets as well as all of the marginal edges. The method used for joining certain areas of the two fabrics together could consist of sewing, or if the fabrics are formed from thermosetting filaments, or threads, the two layers might be joined together by heat fusion.

Other objects and advantages will be apparent to those skilled in the art after reading the following specification in connection with the annexed drawings in which FIGS. 1 and 2 illustrate the two alternative positions of the ski poles for suspending the improved ski seat between them;

FIG. 3 is a perspective view on an enlarged scale of the ski seat of FIGS. 1 and 2 illustrating the insertion of one of the upper ends of a ski pole into the inverted pocket formed at one end;

FIG. 4 is a plan view of the outer face of the ski seat shown in FIG. 3;

FIGS. 5, 6 and 7 are cross-sections of the article shown in FIG. 4 and taken respectively on the lines denoted A—A; B—B C—C, and;

FIG. 8 is a perspective view showing the use of a belt to attach the collapsed ski seat to the waist so as to provide an extra suspended pouch, or pocket.

In the drawings, FIG. 1 shows the use of the ski seat, indicated by numeral 10 with the handles of a pair of horizontally-spaced, vertically-positioned ski poles 11 inserted into the endmost pockets to suspend the seat between the poles, while FIG. 2 illustrates the use of the ski poles in a crossed position.

In its preferred form, the seat essentially comprises a tubular flattened elongated fabric article having closed end margins 12 and 13. These marginal portions thus define the bottoms of a pair of inwardly facing pockets indicated by numerals 14 and 15. At about 6 inches from the end of each margin, the tubular material is provided with a longitudinally extending slit about 3¼ inches in length and indicated by numerals 16 and 17. If, as previously noted, it is desired to provide for using the seat with ski poles of different heights, at least one more pocket can be provided by transversely closing the flattened tubular fabric along the narrow area 19 to define the bottom of an inwardly facing pocket 18 which in turn is provided with a longitudinally extending slit 20 in order to permit the insertion of the end of a ski pole in order to shorten the length of suspended material so as to raise the position of the central area 21 upon which the user sits.

While several methods of fabricating the article are possible, it is preferable to weave the entire article on a narrow fabric loom by procedures which are described in the U.S. Pat. No. 3,095,017, granted to Bleiler et al on June 25, 1963. Basically, a set of warp threads extends along the length of the article and weft threads are inserted through various combinations of warp threads as a result of manipulation of the loom harness as is well known in the textile art.

Thus, while most of the length of the article, comprising the sections 14, 18, 21 and 15, are woven in a flattened, tubular form, the areas 12, 13 and 19 consist of only a single ply and they are formed by interrupting the tubular weave and by inserting a weft binder thread for a sufficient number of courses to extend about an inch in length of the article. Preferably, a thermoplastic thread, such as nylon, is used so that the trailing end margin 13 of one article and the leading end margin 12 of a succeeding article can be formed by weaving a single ply area which is equal to the width of both end margins, and thereafter cutting the fabric across the midpoint of that area and searing the exposed ends of the threads to prevent unraveling.

Therefore, assuming that the weaving of the single ply end margin 12 has been completed, the loom harness is reset to weave a two ply tube as shown in FIG. 6 for about 6 inches to form the pocket 14. At this point, the harness is changed to weave the slit 16, as indicated in FIG. 7, for about 3 or 4 inches, at which point, the harness is again changed to weave a solid single ply fabric to provide the area 19, as shown in FIG. 5, for about an inch. The harness is again changed to weave the two ply tubular pocket 18 for another 6 inches, after which the harness is changed to weave the slit 20 for another 3 or 4 inches. Thereafter, the harness is changed back to the tubular weave to fashion the medial area 21, which extends for some 20 inches. Thereafter, the machine is set to produce the slit 17 for 3 or 4 inches, at which point the tubular weave is restored to make the pocket 15, which is closed off by the solid single ply area 13. As noted above, the single ply end margin 12 of a succeeding article is but a continuation of margin 13, and in this way, the loom need not be stopped, but can be programmed to produce any number of successive articles continuously because the severing of the fabric to make the separate articles and the searing of the threads may take place later.

While reference has been made to the Bleiler et al patent, it should be understood that numerous variations in the technique of weaving are available, some of which are disclosed in U.S. Pat. No. 1,137,405, granted to Jennings Apr. 27, 1915; U.S. Pat. No. 3,266,529, granted to Bunger on Aug. 16, 1966, and; U.S. Pat. No. 3,472,288, granted to Kohlhagen Oct. 14, 1969.

FIG. 8 illustrates how the article can be used as a pouch for carrying small articles when not in use as a seat by inserting a belt, or strap, 22 into the tubular portion 21 from the slit 20 to the slit 17, so that by gathering the material together on the belt, the belt itself can be fastened around the user's waist with the result that the pocket 14 will thus be suspended in a position to enable it to be used for carrying small articles.

What is claimed is:

1. A portable seat to be suspended between a pair of ski poles comprising a narrow elongated fabric web having a pocket formed at each end of the web facing toward the center, said fabric web comprising essentially a flattened tube having two layers of superposed fabric material, the two layers of material being formed together across their entire width along a short length of the respecting opposite ends of web to define the bottom of the respective pockets at each end, a pair of slits being produced in one layer of said fabric to provide access to the interior of each of the respective pockets to thereby permit the pockets to receive the upper extremities of the ski poles to suspend the medial portion of the web between the pair of poles.

2. The invention defined in claim 1, wherein said flattened tube comprises an integrally woven fabric article.

3. The invention defined in claim 1, wherein said slits extend in a longitudinal direction, the outermost ends of the slits being inwardly spaced from defining the bottoms of the pockets.

4. The invention defined in claim 1, wherein said web is provided with another pocket facing toward the center and spaced inwardly from one of the first mentioned pockets to receive the upper extremity of the one of the ski poles to change the height of the seat.

5. A portable seat to be suspended between a pair of ski poles comprising a narrow elongated fabric web having a pocket formed at each end of the web facing toward the center, each of the respective pockets being intended to receive the upper extremity of one of the ski poles to suspend the medial portion of the web between the pair of poles, each of the pockets formed at the ends of the fabric web comprising two layers of fabric, the two layers being joined to each other at the end of the web and along two sides to define said pockets, said two layers of fabric being dissociated from each other along a line spaced from the end to permit insertion of the upper extremity of a pole into said pocket.

6. A portable seat comprising a pair of poles, one end of each pole being provided with means for engagement with the ground, or other supporting surface, to prevent horizontal slippage, and an elongated, narrow web of flexible material suspended between the other ends of the poles, said web comprising two flattened layers of material joined along their peripheral side and end margins to provide an inwardly facing pocket between said two layers, one of said layers of material being provided with at least one opening to permit access of said other ends of the poles into said pocket.

7. The invention defined in claim 6, wherein said web is detachable from the poles.

8. The invention defined in claim 7, wherein said web is provided with at least one additional inwardly facing facing pocket within which the other end of one of the poles can be received to change the height of the seat.

* * * * *